US009388999B2

(12) United States Patent
De Jesus

(10) Patent No.: US 9,388,999 B2
(45) Date of Patent: Jul. 12, 2016

(54) WINDOW SECURITY ASSEMBLY

(71) Applicant: Angel De Jesus, Elizabeth, NJ (US)

(72) Inventor: Angel De Jesus, Elizabeth, NJ (US)

( * ) Notice: Subject to any disclaimer, the term of this patent is extended or adjusted under 35 U.S.C. 154(b) by 0 days.

(21) Appl. No.: 14/515,631

(22) Filed: Oct. 16, 2014

(65) Prior Publication Data

US 2016/0109150 A1 Apr. 21, 2016

(51) Int. Cl.

| | |
|---|---|
| ***E06B 3/68*** | (2006.01) |
| ***F24F 13/32*** | (2006.01) |
| ***E06B 5/11*** | (2006.01) |
| ***E06B 9/01*** | (2006.01) |
| ***F24F 1/02*** | (2011.01) |
| ***E06B 7/28*** | (2006.01) |
| *E06B 9/00* | (2006.01) |

(52) U.S. Cl.

CPC . *F24F 13/32* (2013.01); *E06B 5/11* (2013.01); *E06B 7/28* (2013.01); *E06B 9/01* (2013.01); *F24F 1/027* (2013.01); *E06B 2009/002* (2013.01); *E06B 2009/015* (2013.01)

(58) Field of Classification Search

CPC ..... F24F 13/32; F24F 1/027; E06B 9/01; E06B 9/06; E06B 5/11; E06B 2009/015; E06B 2009/002

USPC ..... 49/50, 55, 57

See application file for complete search history.

(56) References Cited

U.S. PATENT DOCUMENTS

| | | | | | |
|---|---|---|---|---|---|
| 2,711,769 | A | | 6/1955 | Katcher et al. | |
| 2,882,810 | A | * | 4/1959 | Goettl | 454/338 |
| 2,891,754 | A | * | 6/1959 | Kuhlenschmidt et al. | 248/208 |
| 2,914,075 | A | * | 11/1959 | Wells et al. | 62/331 |
| 3,011,424 | A | | 12/1961 | Kohnen | |
| 3,195,506 | A | * | 7/1965 | Beard | 119/496 |
| 3,273,843 | A | * | 9/1966 | Bell, Jr. et al. | 248/208 |
| 4,038,791 | A | * | 8/1977 | Atkinson | 312/102 |
| D246,379 | S | | 11/1977 | Mueller | |
| 4,202,389 | A | | 5/1980 | Ewald | |
| 4,445,459 | A | * | 5/1984 | Julie | 119/28.5 |
| 4,989,546 | A | * | 2/1991 | Cannaday | 119/484 |
| 5,167,202 | A | * | 12/1992 | Bradford et al. | 119/452 |
| 5,469,807 | A | * | 11/1995 | Kosmaczeska | 119/484 |
| 5,960,586 | A | * | 10/1999 | Chen | 47/40 |
| D424,249 | S | * | 5/2000 | Banzaca | D30/119 |
| 6,092,488 | A | * | 7/2000 | Allawas | 119/497 |
| 6,401,663 | B1 | * | 6/2002 | Meier, Jr. | 119/452 |
| 6,722,315 | B2 | * | 4/2004 | Sinor | 119/484 |
| 6,912,974 | B2 | * | 7/2005 | Ozeri et al. | 119/484 |
| 6,944,990 | B2 | * | 9/2005 | Noyes | 49/169 |
| D549,401 | S | * | 8/2007 | Mercier et al. | D30/114 |
| D634,413 | S | * | 3/2011 | Wallace | D23/354 |
| 8,357,031 | B2 | | 1/2013 | Dinicolas | |
| 8,414,367 | B1 | * | 4/2013 | Virag et al. | 454/204 |

(Continued)

FOREIGN PATENT DOCUMENTS

KR 10-1300156 * 8/2013

*Primary Examiner* — Jerry Redman

(57) ABSTRACT

A window security assembly includes a cage structured to have a rectangular parallelepiped shape. The cage is further structured to have first section slidably coupled to a second section so the cage has an adjustable width. The cage is further structured to have an open side. The cage is positioned in a window such that the open side receives an air conditioner mounted in the window to surround the air conditioner. Each of a plurality of fasteners extends through the cage and engages the window such that the cage prevents an individual from tampering with the air conditioner or entering through the window.

1 Claim, 5 Drawing Sheets

(56) References Cited

U.S. PATENT DOCUMENTS 8,714,108 B1 * 5/2014 Mickle ..... 119/165
8,998,690 B1 * 4/2015 Virag et al. ..... 454/204
9,072,275 B2 * 7/2015 Kleuskens
2002/0144463 A1 * 10/2002 Liddell ..... 49/57

* cited by examiner

WINDOW SECURITY ASSEMBLY

BACKGROUND OF THE DISCLOSURE

Field of the Disclosure

The disclosure relates to security devices and more particularly pertains to a new security device for securing a window containing a window mounted air conditioner.

SUMMARY OF THE DISCLOSURE

An embodiment of the disclosure meets the needs presented above by generally comprising a cage structured to have a rectangular parallelepiped shape. The cage is further structured to have a first section slidably coupled to a second section so the cage has an adjustable width. The cage is further structured to have an open side. The cage is positioned in a window such that the open side receives an air conditioner mounted in the window to surround the air conditioner. Each of a plurality of fasteners extends through the cage and engages the window such that the cage prevents an individual from tampering with the air conditioner or entering through the window.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
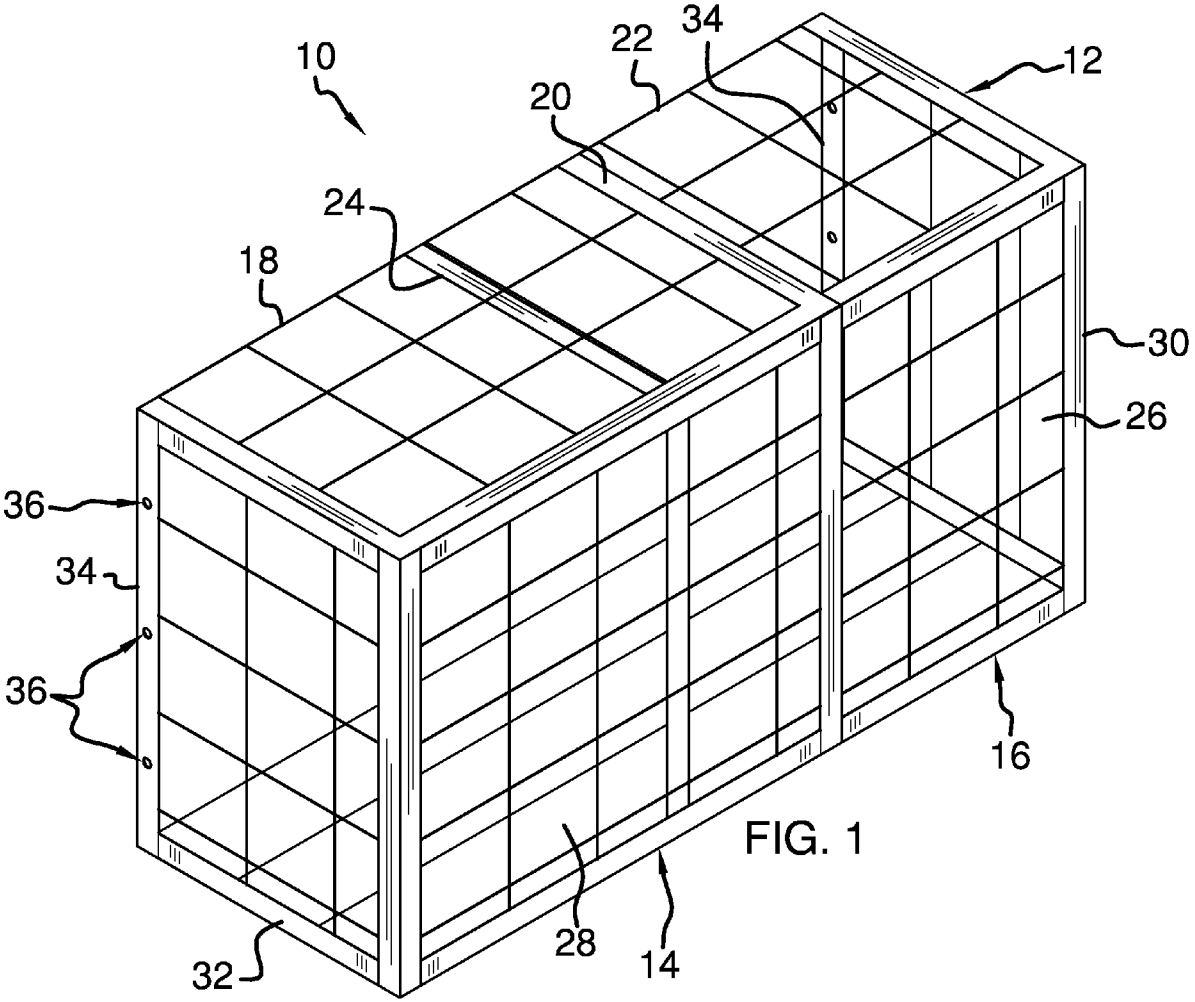
FIG. 1 is a perspective view of a window security assembly according to an embodiment of the disclosure.
Figure 2:
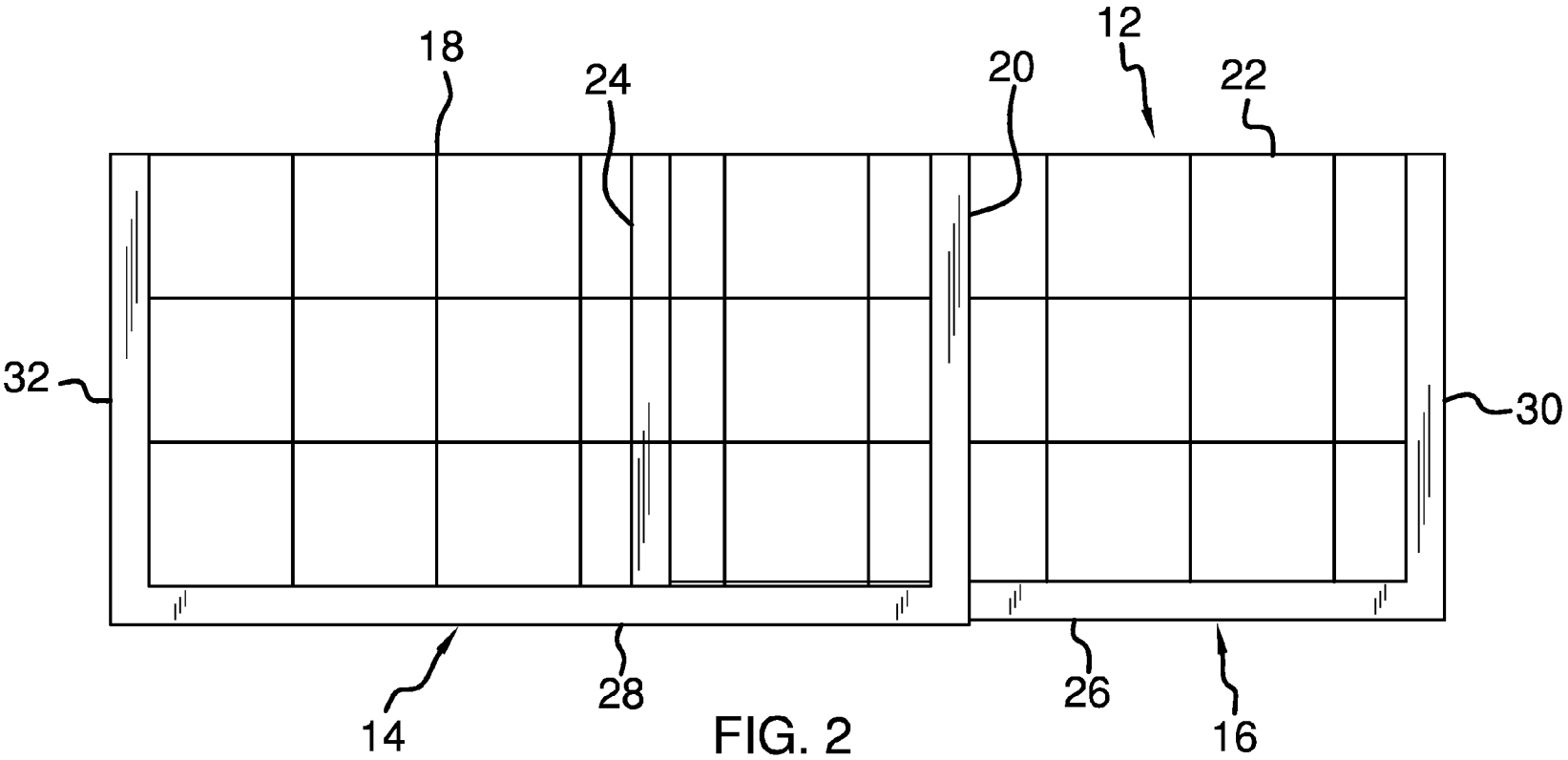
FIG. 2 is a top view of an embodiment of the disclosure.
Figure 3:
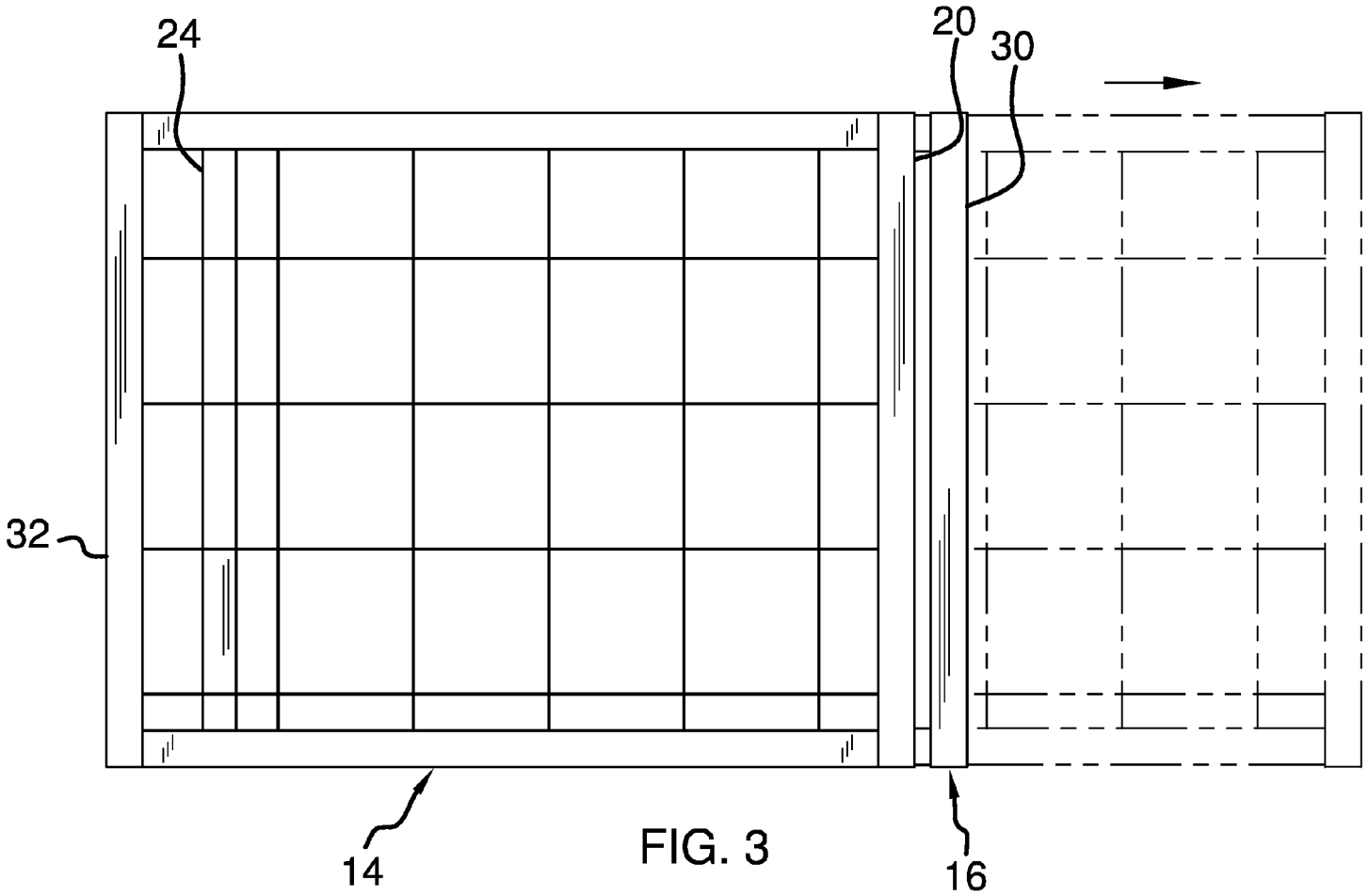
FIG. 3 is a back view of an embodiment of the disclosure.
Figure 4:
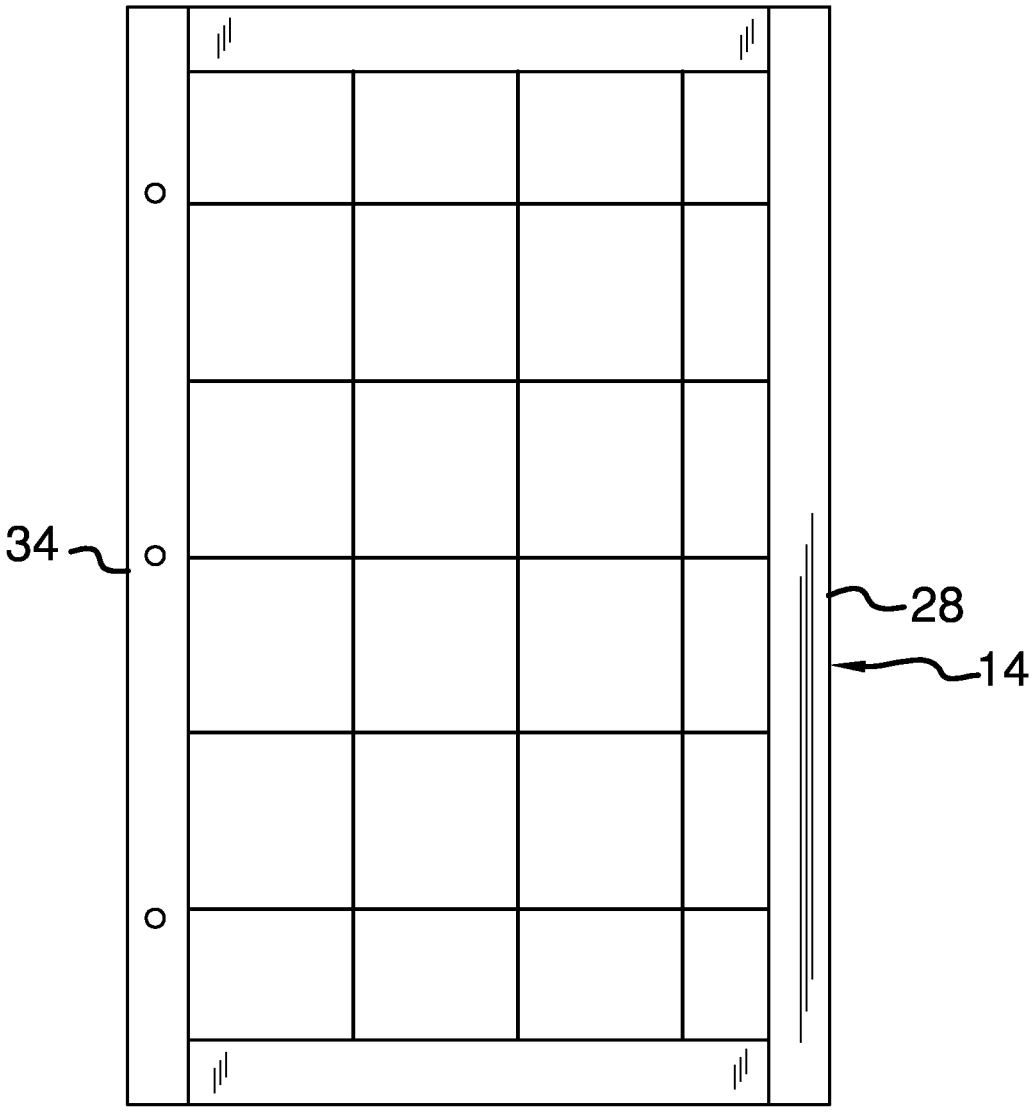
FIG. 4 is a left side view of an embodiment of the disclosure.
Figure 5:
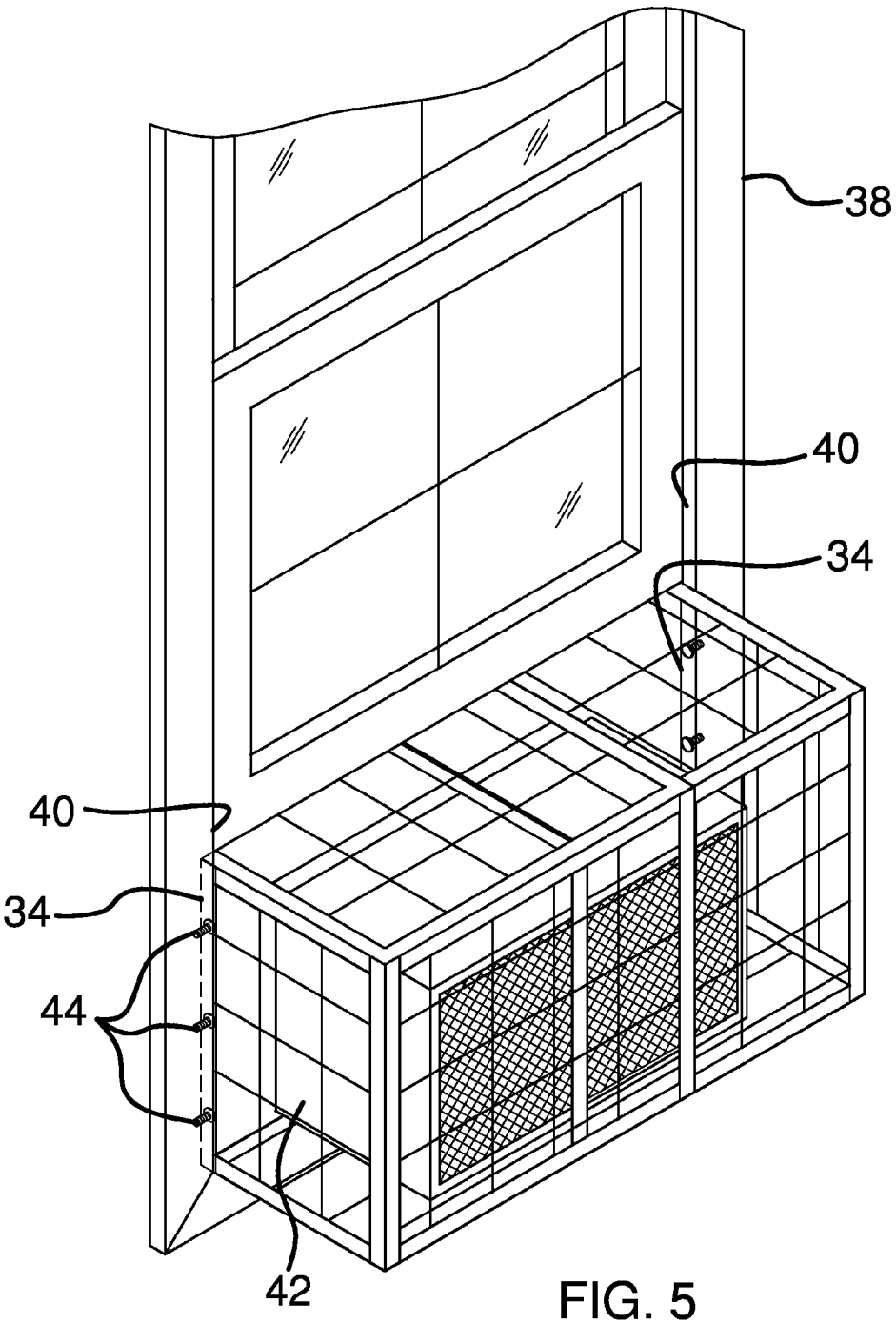
FIG. 5 is an in-use view of an embodiment of the disclosure.

With reference now to the drawings, and in particular to FIGS. 1 through 5 thereof, a new security device embodying the principles and concepts of an embodiment of the disclosure and generally designated by the reference numeral 10 will be described.

As best illustrated in FIGS. 1 through 5, the window security assembly 10 generally comprises a cage 12 structured to have a rectangular parallelepiped shape. The cage 12 is further structured to have first section 14 slidably coupled to a second section 16. Each of a front side 18 and a first lateral side 20 of the first section 14 is open. Moreover, each of a forward side 22 and a first oblique side 24 of the second section 16 is open. A rearmost side 26 of the second section 16 slidably engages a backmost side 28 of the first section 14 such that a second oblique side 30 of the second section 16 is positionable at a selected distance from a second lateral side 32 of the first section 14. Thus, the cage 12 has an adjustable width.

Each a pair of forwardmost arms 34 of the cage 12 corresponding to a respective one of the first section 14 and the second section 16 has a plurality of openings 36 extending laterally therethrough. The openings 36 are evenly spaced apart and distributed along an entire length of each of the forwardmost arms 34. The cage 12 is positioned within a window 38. The window 38 may be a window of a building or the like.

The second section 16 is slidably adjusted with respect to the first section 14 such that each of the forwardmost arms 34 abuts an associated one of a pair of bounding vertical edges 40 of the window 38. Thus, the cage 12 extends across an entire width of the window 38. Each of the front side 18 of the first section 14 and the forward side 22 of the second section 16 receives an air conditioner 42 mounted in the window 38 so the cage 12 surrounds the air conditioner 42. Each of a plurality of fasteners 44 extends through an associated one of the openings 36 and engages the respective bounding vertical edges 40 of the window 38 to prevent an individual from tampering with the air conditioner 42 or entering through the window 38. The air conditioner 42 may be a window mounted air conditioner or the like.

In use, the assembly 10 is utilized when the window 38 is positioned in an open position to accommodate the air conditioner 42. The assembly 10 is coupled to the window 38 the entire time that the air conditioner 42 is mounted in the window 38. Moreover, the assembly 10 is removed from the window 38 after the air conditioner 42 is removed from the window 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A window security assembly comprising:

a cage structured to have a rectangular parallelepiped shape, having closed planar ends;

said cage being further structured to have a first section slidably coupled to a second section, each of a front side and a first lateral side of said first section being open, each of a forward side and a first oblique side of said second section being open, a rearmost side of said second section slidably engaging a backmost side of said first section such that a second oblique side of said second section is positionable at a selectable distance from a second lateral side of said first section wherein said cage has an adjustable width;

each a pair of forwardmost vertically planer arms of said cage corresponding to a respective one of said first section and said second section having a plurality of openings extending laterally therethrough, said openings being evenly spaced apart and distributed along an entire length of each of said forwardmost arms;

said cage being positioned within a window having said second section being slidably adjusted with respect to said first section such that each of said forwardmost arms abuts an associated one of a pair of bounding vertical edges of a window frame wherein said cage is configured to extend across an entire width of a window opening, said front side of said first section and said forward side of said second section receiving an air conditioner mounted in the window wherein said cage is configured to surround the air conditioner;

each of a plurality of fasteners extending through an associated one of said openings and engaging the window frame perpendicularly to the window opening such that said closed planar ends of said cage are adjacent to the window frame and said cage is configured to prevent an individual from tampering with the air conditioner or entering through the window opening; and the security assembly is only attached by the plurality of fasteners extending through the vertical planer arms.

* * * * *